US010752328B1

(12) United States Patent
Bielefeld et al.

(10) Patent No.: US 10,752,328 B1
(45) Date of Patent: Aug. 25, 2020

(54) GEAR MOUNTING ASSEMBLIES FOR ONE OR MORE PROPELLERS ON A MARINE DRIVE

(71) Applicant: Brunswick Corporation, Mettawa, IL (US)

(72) Inventors: Brett Bielefeld, Fond du Lac, WI (US); Joshua S. Smith, Mayville, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/242,469

(22) Filed: Jan. 8, 2019

(51) Int. Cl.

| | |
|---|---|
| ***B63H 23/34*** | (2006.01) |
| ***B63H 23/02*** | (2006.01) |
| ***B63H 23/08*** | (2006.01) |
| ***B63H 23/32*** | (2006.01) |
| ***B63H 1/20*** | (2006.01) |

(52) U.S. Cl.
CPC ..... *B63H 23/34* (2013.01); *B63H 1/20* (2013.01); *B63H 23/02* (2013.01); *B63H 23/08* (2013.01); *B63H 23/32* (2013.01); *B63H 2023/342* (2013.01)

(58) Field of Classification Search
CPC ..... B63H 20/00; B63H 20/14; B63H 20/20; B63H 20/26; B63H 20/32; B63H 5/00; B63H 5/07; B63H 5/10; B63H 23/00; B63H 23/02; B63H 23/08; B63H 23/32; B63H 23/34
USPC ..... 440/78, 79, 80, 81, 83
See application file for complete search history.

(56) References Cited

U.S. PATENT DOCUMENTS

| | | | |
|---|---|---|---|
| 2,362,141 | A | 11/1944 | Loetterle |
| 4,099,478 | A | 7/1978 | Alexander, Jr. |
| 4,373,922 | A | 2/1983 | Weed |
| 4,583,628 | A | 4/1986 | McCormick |
| 4,600,395 | A | 7/1986 | Pichl |
| 4,642,057 | A | 2/1987 | Frazzell et al. |
| 4,792,314 | A | 12/1988 | McCormick |
| 4,795,382 | A | 1/1989 | McCormick |
| 4,832,636 | A | 5/1989 | McCormick |
| 4,869,121 | A | 9/1989 | Meisenburg |
| 4,897,058 | A | 1/1990 | McCormick |
| 4,900,281 | A | 2/1990 | McCormick |
| 4,955,833 | A | 9/1990 | Lam et al. |
| 4,986,775 | A | 1/1991 | Wantz |
| 5,214,975 | A | 6/1993 | Zalewski |
| 5,249,995 | A | 10/1993 | Meisenburg et al. |
| 5,601,464 | A | 2/1997 | Ogino et al. |
| 5,791,950 | A | 8/1998 | Weronke et al. |

(Continued)

*Primary Examiner* — Lars A Olson
(74) *Attorney, Agent, or Firm* — Andrus Intellectual Property Law, LLP

(57) ABSTRACT

A gear mounting assembly is for causing rotation of a propeller on a marine drive. The assembly includes a driveshaft; a first bevel gear on the driveshaft, wherein rotation of the driveshaft causes rotation of the first bevel gear; a propeller shaft for supporting the propeller such that rotation of the propeller shaft causes rotation of the propeller; a gear hub on the propeller shaft; a second bevel gear on the gear hub, wherein the second bevel gear is engaged with the first bevel gear such that rotation of the driveshaft causes rotation of the gear hub, which thereby causes rotation of the propeller shaft; and an adapter facilitating relative rotation between the propeller shaft and the gear hub when the gear hub is caused to rotate by the driveshaft.

20 Claims, 10 Drawing Sheets

(56) References Cited

U.S. PATENT DOCUMENTS

| | | | | |
|---|---|---|---|---|
| 5,890,938 | A * | 4/1999 | Eick | B63H 5/10 440/80 |
| 5,902,160 | A | 5/1999 | Weronke et al. | |
| 6,068,529 | A | 5/2000 | Weronke et al. | |
| 6,176,750 | B1 | 1/2001 | Alexander et al. | |
| 6,478,543 | B1 | 11/2002 | Tuchscherer et al. | |
| 7,086,836 | B1 | 8/2006 | Sheth et al. | |
| 7,188,543 | B1 * | 3/2007 | Andrews | B63H 23/02 74/431 |
| 8,277,269 | B1 | 10/2012 | Alby et al. | |
| 2017/0159705 | A1 * | 6/2017 | Hikosaka | B63H 20/14 |

* cited by examiner

GEAR MOUNTING ASSEMBLIES FOR ONE OR MORE PROPELLERS ON A MARINE DRIVE

FIELD

The present disclosure relates to marine drives, and particularly to assemblies for causing rotation of one or more propellers on marine drives.

BACKGROUND

The following U.S. Patents are incorporated herein by reference:

U.S. Pat. No. 4,642,057 discloses a marine propeller mounting arrangement having a sleeve member for mounting on a propeller shaft, a propeller having an inner hub which fits over the sleeve member and a cushion member fitting between the sleeve member and the propeller inner hub. The sleeve member includes radially extending projections registering with channels in the hub to positively drive the propeller, even in the event of failure of the cushion member. The propeller has an outer hub surrounding the inner hub to define an exhaust gas passageway through the propeller.

U.S. Pat. No. 4,795,382 discloses a marine drive unit having a lower gear case forming a torpedo housing. A pair of coaxial propeller shafts is mounted in the housing and carries a pair of propellers thereon. The propeller shafts are driven by a pair of opposed driving gears suitably connected through a generally vertical main drive shaft to a marine engine and mounted on the horizontal drive axis. A pair of thrust bearings adapted to carry forward thrust loads are respectively disposed adjacent the facing portions of the opposed driving gears, with the pair being separated by a spacer tightly confined there between. The spacer is locked against rotation but is freely floatable in an axial direction, and transfers the forward thrust load from one bearing to the other, so that the load is ultimately transferred from the outer propeller shaft to the inner central shaft.

U.S. Pat. No. 4,832,636 discloses a marine drive unit having a lower torpedo housing. At least one propeller shaft is mounted in the housing for rotation about a drive axis. The propeller shaft is driven by a driving gear suitably connected to a marine engine and mounted on the drive axis. A first forward thrust bearing is disposed between the driving gear and the housing. In addition, a second forward thrust bearing is disposed adjacent the forward end of the propeller shaft. A pre-loading device, in the present example a washer-like Belleville spring of a desired capacity, is disposed to provide an adjustable biasing force on the second thrust bearing.

U.S. Pat. No. 6,478,543 discloses a torque transmitting device for use in conjunction with a marine propulsion system, which provides an adapter that is attached in torque transmitting relation with a propulsor shaft for rotation about a central axis of rotation. The first insert portion is attached in torque transmitting relation with the adapter and a second insert portion is attached in torque transmitting relation with a hub of the propulsor hub which can be a marine propeller or an impeller. A third insert portion is connected between the first and second insert portions and is resilient in order to allow the first and second insert portions to rotate relative to each other about the central axis of rotation. The adapter is shaped to prevent compression of the first, second, and third insert portions in a direction parallel to the central axis of rotation. The relative shapes of the various components and the resilience of the third insert portion, which can be a plurality of titanium rods, provides significant compliance of the device under low torque magnitudes, but at higher torque magnitudes it provides a significantly decreased compliance to facilitate torque transfer between a propulsor shaft and the propulsor hub.

U.S. Pat. No. 7,086,836 discloses a torque transfer mechanism for a marine propulsion system, which provides a connector mechanism, a first torque transfer mechanism, and a second torque transfer mechanism. A plurality of rods can provide the first torque transfer mechanism and a polymer component is shaped to provide the second torque transfer mechanism. All torque below a preselected magnitude is transferred through the first torque transfer mechanism and, for magnitudes of torque above the threshold, torque is transferred by both the first and second torque transfer mechanisms. The connector mechanism has an outer surface that is not used to transfer torque between it and an inner hub of a propulsor.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter. In certain examples disclosed herein, an assembly is for causing rotation of a propeller on a marine drive. The assembly includes a driveshaft; a first bevel gear on the driveshaft, wherein rotation of the driveshaft causes rotation of the first bevel gear; a propeller shaft for supporting the propeller such that rotation of the propeller shaft causes rotation of the propeller; a gear hub on the propeller shaft; a second bevel gear on the gear hub, wherein the second bevel gear is engaged with the first bevel gear such that rotation of the driveshaft causes rotation of the gear hub, which thereby causes rotation of the propeller shaft; and an adapter facilitating relative rotation between the propeller shaft and the gear hub when the gear hub is caused to rotate by the driveshaft.

BRIEF DESCRIPTION OF THE DRAWINGS

The present disclosure is described with reference to the following Figures. The same numbers are used throughout the Figures to reference like features and like components.

DETAILED DESCRIPTION

During research and development, the present inventors recognized that it would be desirable to provide improved gear mounting assemblies that reduce concentrated loading in bearings and gears. The present inventors identified that many conventional gear mounting assemblies locate bevel gears and/or roller bearings directly on the propeller shaft, which can cause misalignment at the gear mesh when the propeller shaft deflects under loads. Based on this realization, the present inventors desired to provide improved gear mounting assemblies that drive torque without rigidly constraining the gear. The inventors desired to provide a gear mounting assemblies that permit the propeller shaft to deflect independently of the gear, which can remain oriented and located by a bearing support directly to the housing. The radial and axial resultant forces would then be directed through these bearings to the housing instead of to the propeller shaft.

To achieve their objectives, the present inventors conceived of the presently disclosed examples, which permit torque transfer between the propeller shaft and gear, but reduce the effect of gear loads on deflection of the propeller shaft and reduce the effect of deflection of the propeller shaft on the misalignment of the gear at the gear mesh. The result is improved gear and bearing life through improved load distribution (less misalignment) within the bearings at the gear mesh.

Figure 1:
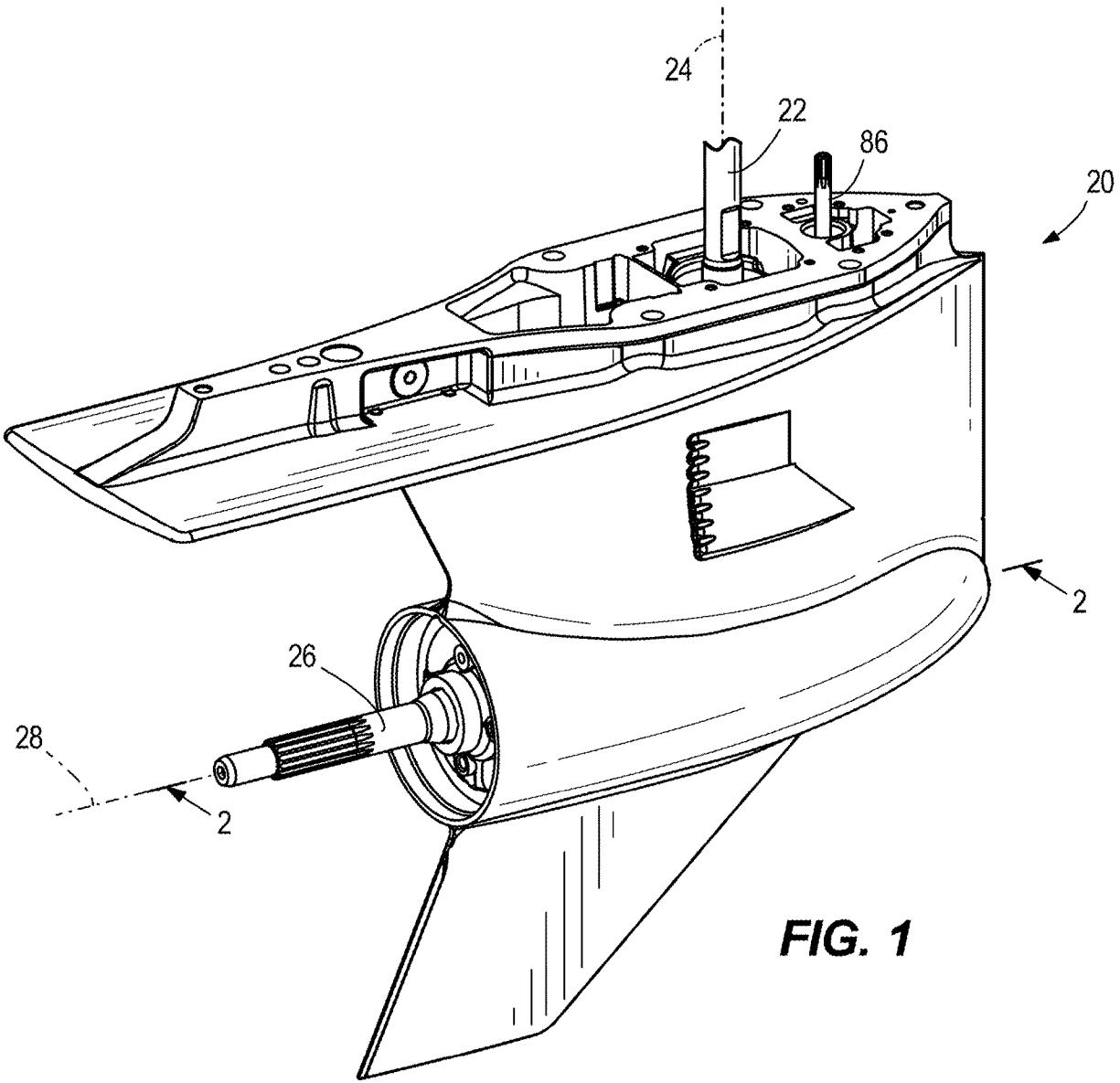
FIG. 1 is a perspective view of a lower gearcase for a marine drive.
Figure 2:
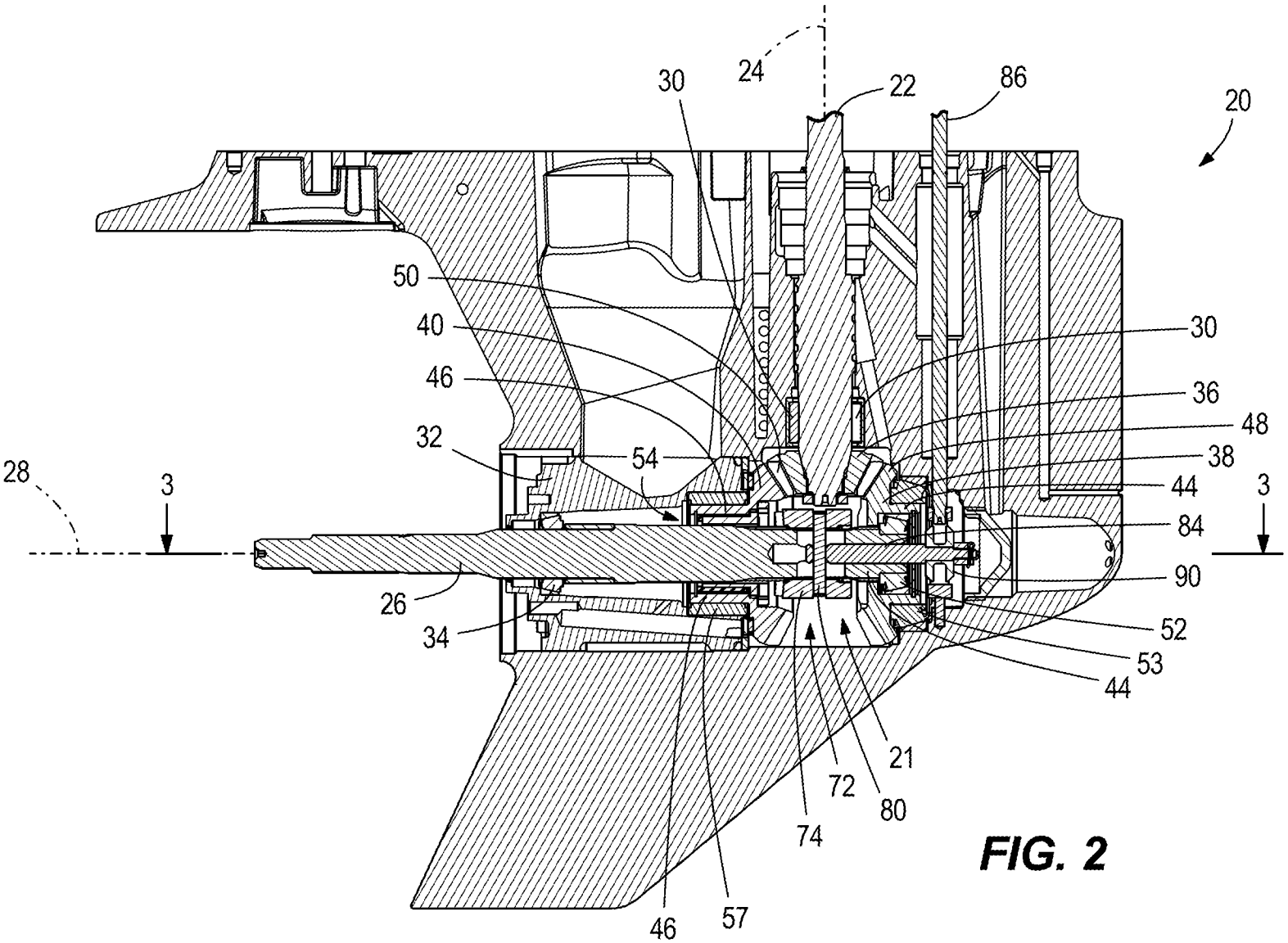
FIG. 2 is a side sectional view of the lower gearcase, showing a first example of a gear mounting assembly according to the present disclosure for supporting rotation of a propeller.
Figure 3:
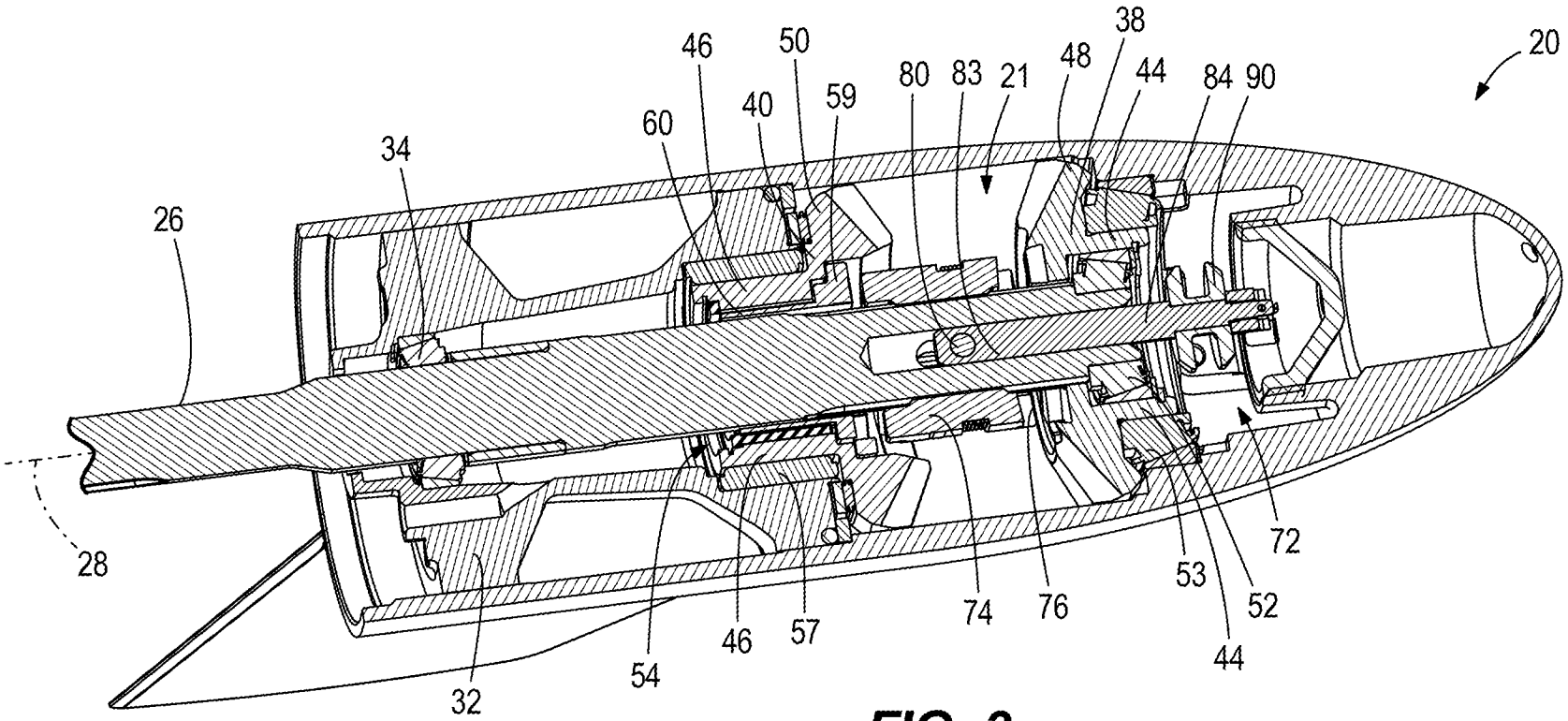
FIG. 3 is a top sectional view of the lower gearcase and first example.
Figure 4:
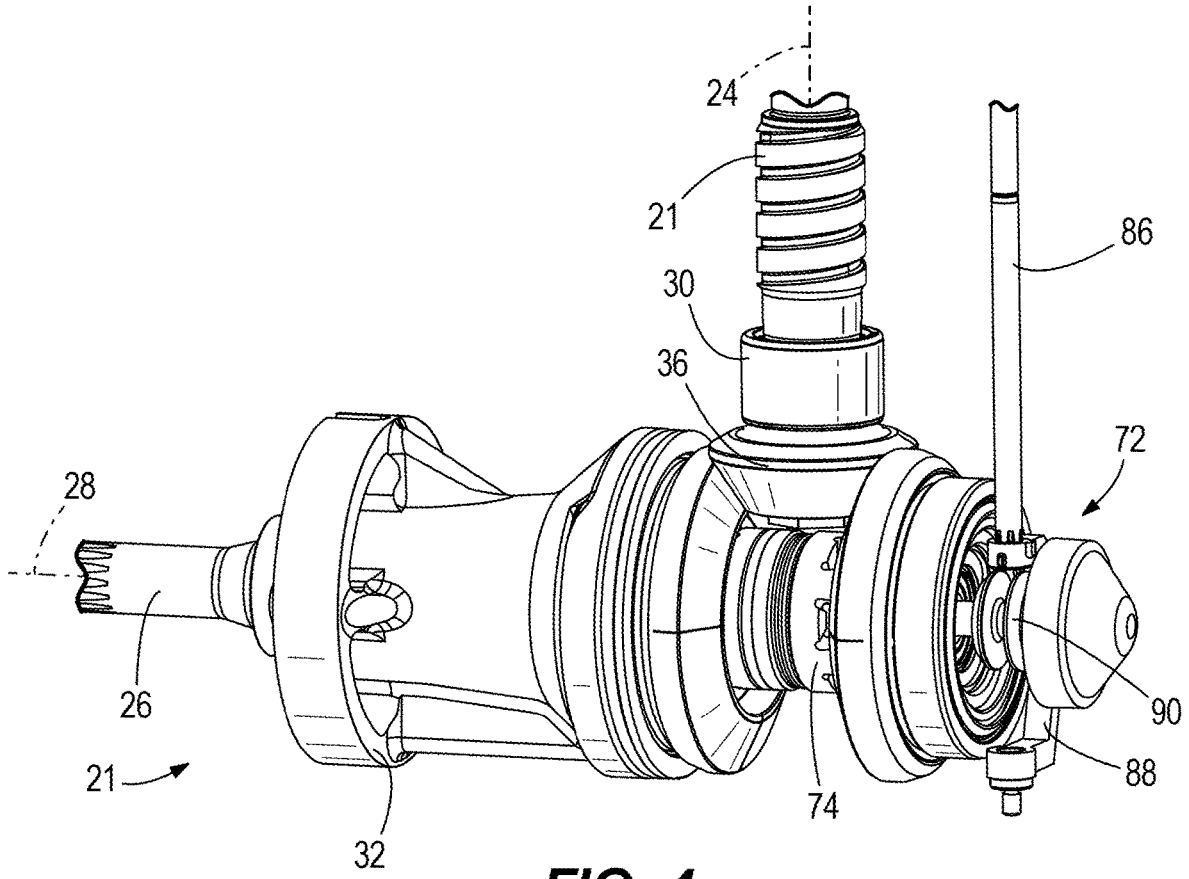
FIG. 4 is a perspective view looking back at the first example.
Figure 5:
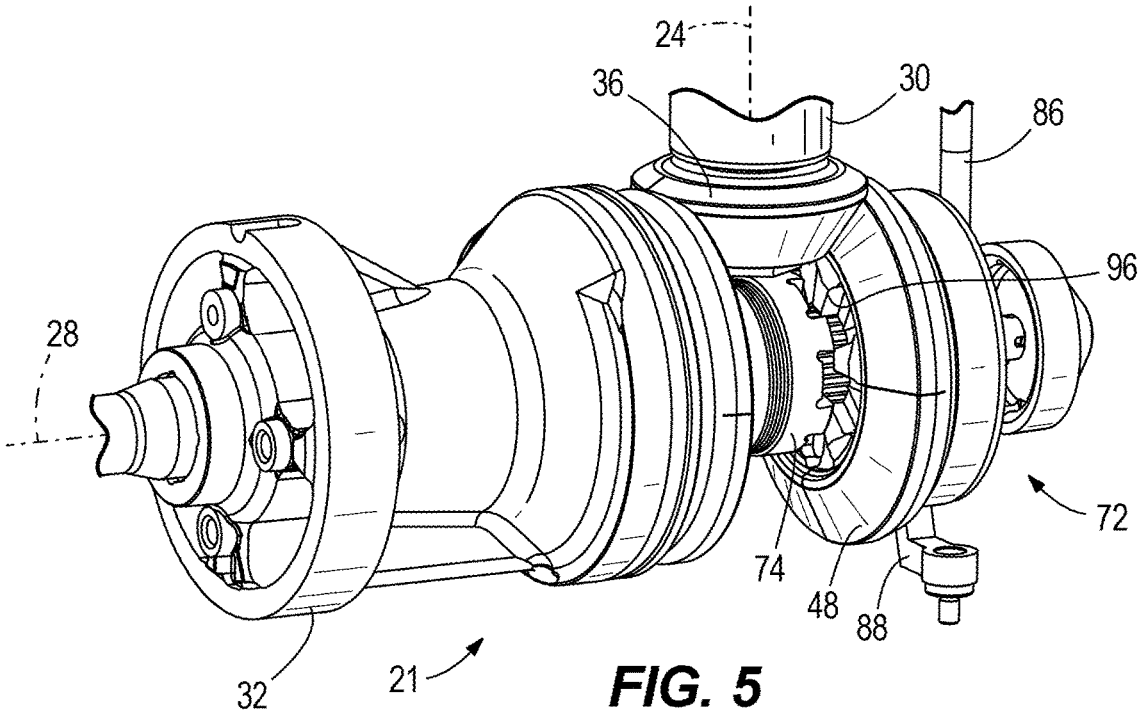
FIG. 5 is a perspective view looking forward at the first example.

FIGS. 1-3 depict a gearcase 20 for a marine drive, which in the illustrated example is an outboard motor. The gearcase 20 contains an assembly 21 configured for causing rotation of a conventional propeller (not shown). A driveshaft 22 extends into the gearcase 20. The driveshaft 22 extends along and rotates about a longitudinal axis 24. A propeller shaft 26 extends out of the lower gearcase 20. The propeller shaft 26 is configured to support the propeller so that rotation of the propeller shaft 26 causes rotation of the propeller. The propeller shaft 26 extends along and rotates about a lateral axis 28, which is perpendicular to the longitudinal axis 24. The driveshaft 22 and propeller shaft 26 are perpendicular to each other. A powerhead (not shown), such as an internal combustion engine and/or electric motor and/or any other means for providing power, causes rotation of the driveshaft 22, as is conventional. The type and configuration of the powerhead can widely vary as long as it is capable of causing rotation of the driveshaft 22 about the longitudinal axis 24.

Figure 9:
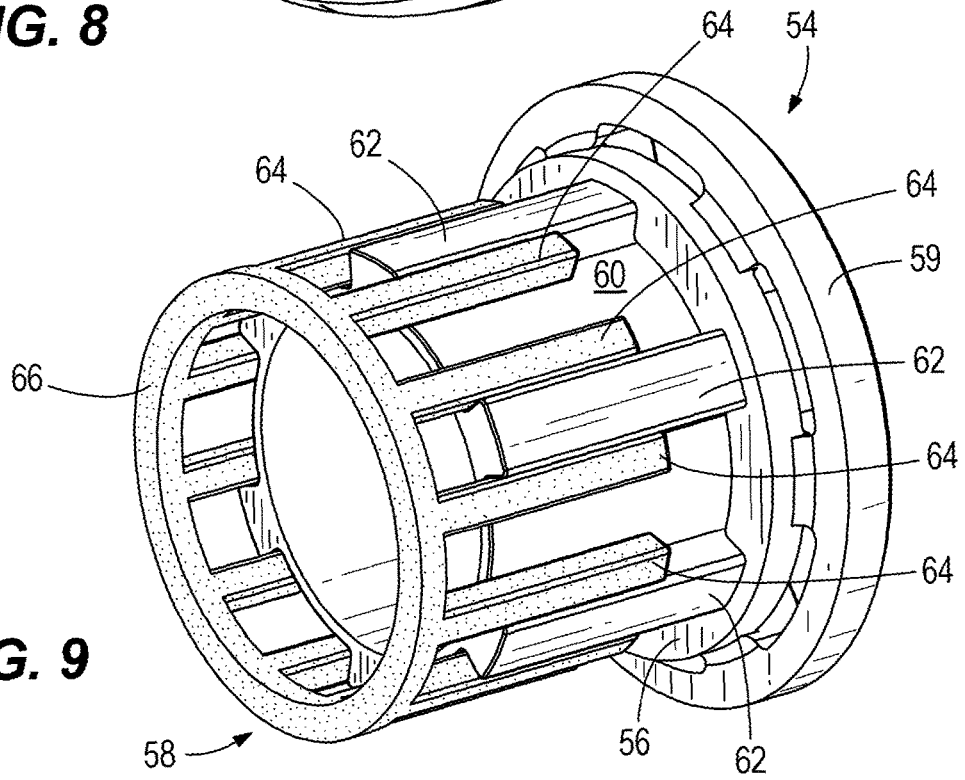
FIG. 9 is a perspective view of the adapter shown in FIG. 8.

Referring to FIGS. 2 and 3, the driveshaft 22 is supported for rotation about the longitudinal axis 24 by roller bearings 30. The propeller shaft 26 laterally extends out of the gearcase 20 and is supported for rotation about the lateral axis 28 by, among other things, a bearing carrier 32 and tapered roller bearings 34. A bevel gear 36 is fixed to the lower end of the driveshaft 22. Rotation of the driveshaft 22 causes commensurate rotation of the bevel gear 36. Forward and reverse gear hubs 38, 40 are located on the propeller shaft 26, and particularly on opposite sides of the lower end of the driveshaft 22 and bevel gear 36. Each gear hub 38, 40 has a hub body 44, 46 that laterally extends along the propeller shaft 26. As shown in FIGS. 2 and 3, the propeller shaft 26 centrally extends through the gear hubs 38, 40. Forward and reverse bevel gears 48, 50 are located on the gear hubs 38, 40 and are engaged with (i.e., meshed with) the bevel gear 36 such that rotation of the driveshaft 22 about the longitudinal axis 24 causes rotation of the respective gear hubs 38, 40 about the lateral axis 28. The gear mesh is not shown with particularity in the drawings; however the gear mesh is conventional and such arrangements are well known in the art. Tapered roller bearings 52 are located radially between the hub body 44 of the forward gear hub 38 and the propeller shaft 26. The tapered roller bearings 52 facilitate relative rotation between the forward gear hub 38 and propeller shaft 26. Tapered roller bearings 53 are located radially between the hub body 44 and the gearcase 20. The tapered roller bearings 53 facilitate rotation of the forward gear hub 38 with respect to the gearcase 20. An adapter 54 (see FIG. 9) is radially located between the propeller shaft 26 and the reverse gear hub 40 and facilitates relative rotation between the propeller shaft 26 and reverse gear hub 40. The adapter 54 is a focus of the present disclosure and will be described in detail herein below. A roller bearing 57 is radially disposed between the bearing carrier 32 and hub body 46 of the reverse gear hub 40 and facilitates rotation of the reverse gear hub 40 with respect to the bearing carrier 55 and gearcase 20.

Referring now to FIGS. 6 and 8-10, the adapter 54 has a laterally elongated adapter body 56 disposed on the propeller shaft 26. The adapter 54 also has a resilient element 58 located radially between the adapter body 56 and the reverse gear hub 40. The resilient element 58 is made of a flexible (elastic) material, such as rubber. As further described herein below, the resilient element 58 is specially configured to facilitate relative rotation between the propeller shaft 26 and the reverse gear hub 40 about the lateral axis 28. The adapter body 56 has a head 59 and a stem 60 that laterally extends from the head 59. The head 59 has a larger diameter than the stem 60. In the example shown in FIGS. 1-10, a plurality of stem ribs 62 laterally extend along the radially outer surface of the stem 60 and are diametrically spaced apart around the stem 60. The resilient element 58 has corresponding laterally extending fingers 64 that are joined at one end by an annular ring 66. The laterally extending fingers are diametrically spaced apart around the annular ring 66 and radially overlap the stem 60. In particular, the laterally extending fingers 64 laterally extend towards the head 59 and are interdigitated with the stem ribs 62 around the radially outer surface of the stem 60.

Figure 10:
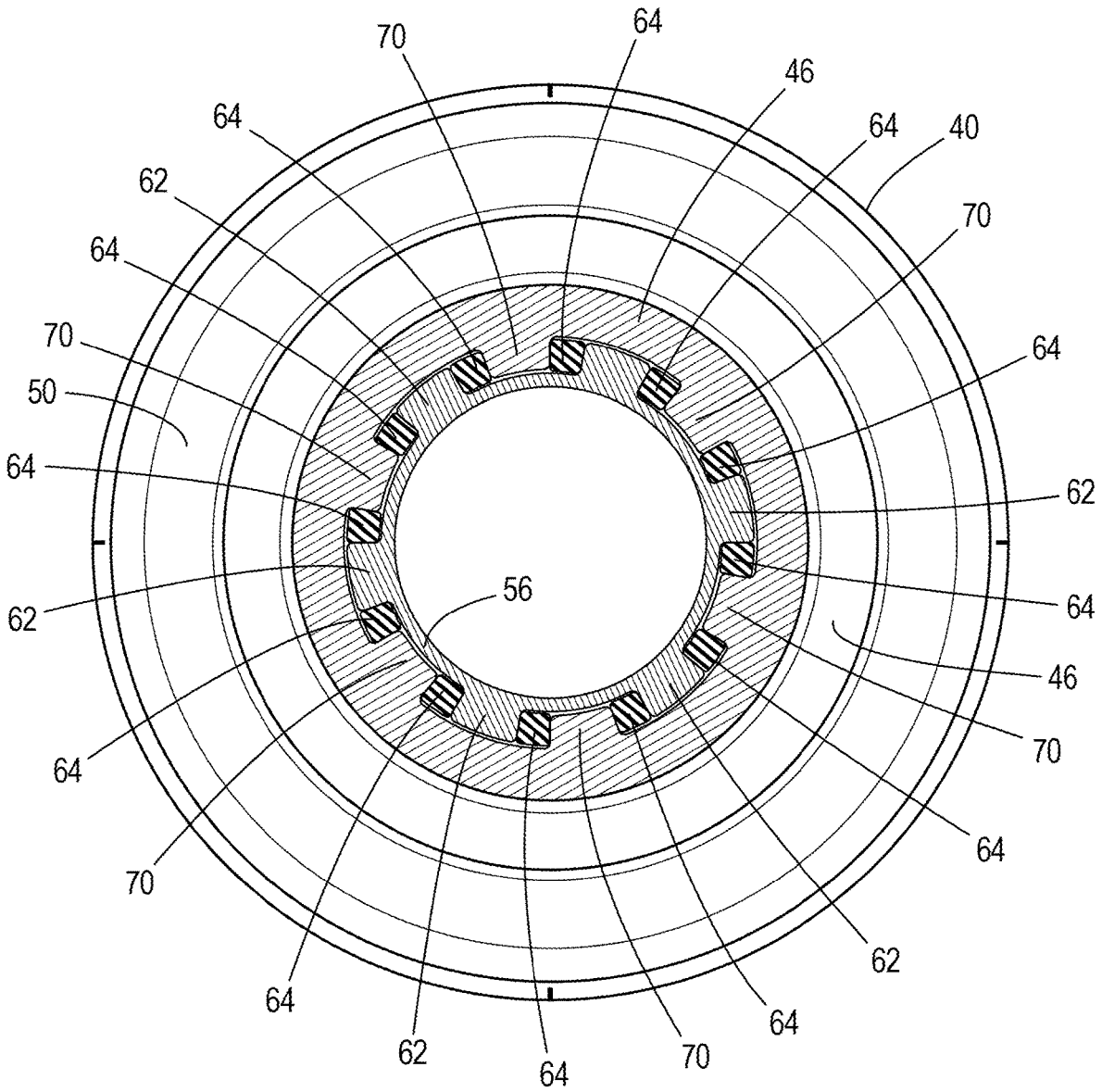
FIG. 10 is a view of section 10-10, taken in FIG. 8.
Figure 11:
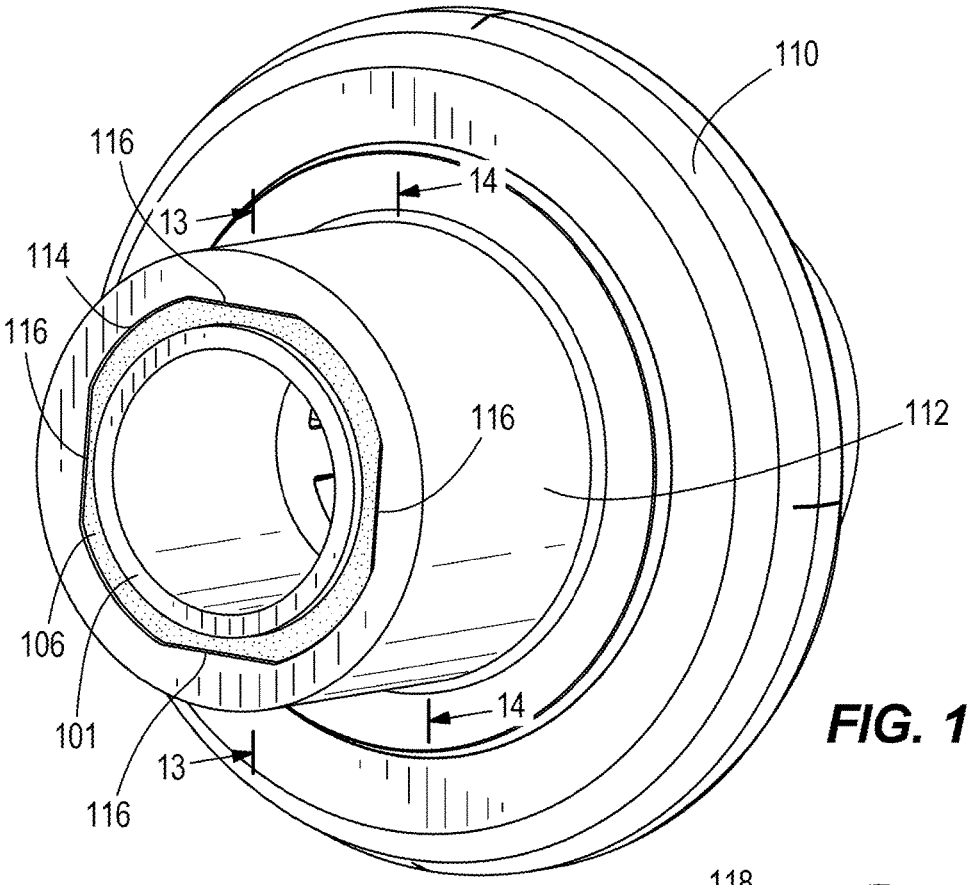
FIG. 11 is a perspective view of a gear hub and adapter according to a second example of the present disclosure.

Referring to FIG. 10, the hub body 46 of the reverse gear hub 40 has a radially inner surface with laterally extending hub ribs 70 that are spaced apart from each other around the radially inner surface. The laterally extending hub ribs 70 are interdigitated with the laterally extending stem ribs 62 and the laterally extending fingers 64 around the stem 60. In particular, as shown in FIG. 10, pairs of laterally extending fingers 64 are located on opposite sides of each of the laterally extending stem ribs 62. The laterally extending hub ribs 70 are on opposite sides of each of the pairs of laterally extending fingers 64 and on each of the laterally extending stem ribs 62. Thus, the adapter 54 is configured so that rotation of the reverse gear hub 40 about the lateral axis 28 causes the laterally extending hub ribs 70 to compress the laterally extending fingers 64 against the laterally extending stem ribs 62, which permits relative rotation to occur between the reverse gear hub 40 and the propeller shaft 26. That is, initial rotation of the reverse gear hub 40 will be "taken up" or "absorbed" as the laterally extending fingers 64 are compressed prior to causing commensurate rotation of the propeller shaft 26, as described further herein below. This can also be referred to as "lost motion" occurring between the adapter 54 and the propeller shaft 26 as the assembly 21 is initially engaged in reverse gear.

Figure 6:
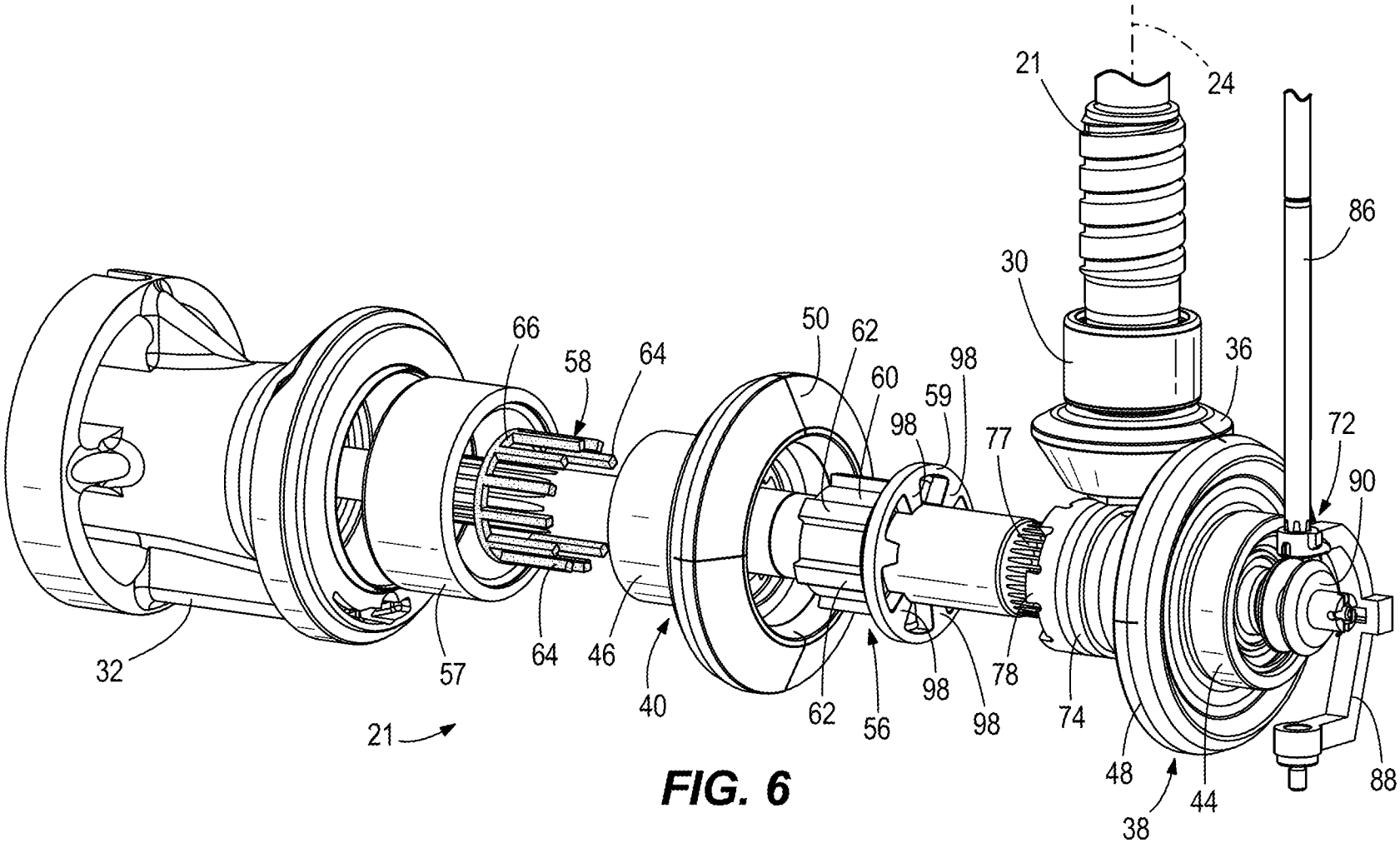
FIG. 6 is an exploded view of the first example.
Figure 7:
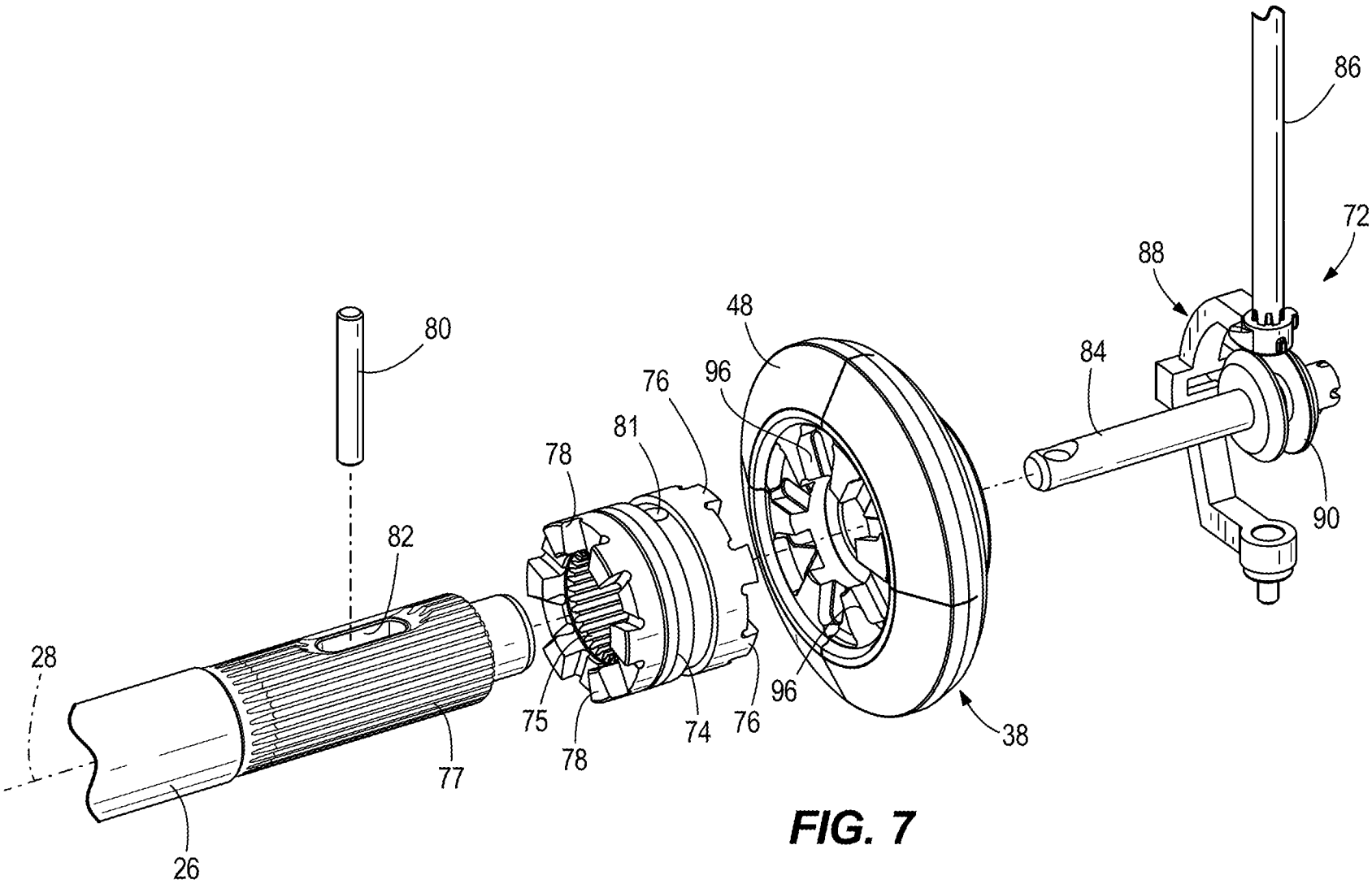
FIG. 7 is an exploded view of a dog clutch for use with the first example.
Figure 8:
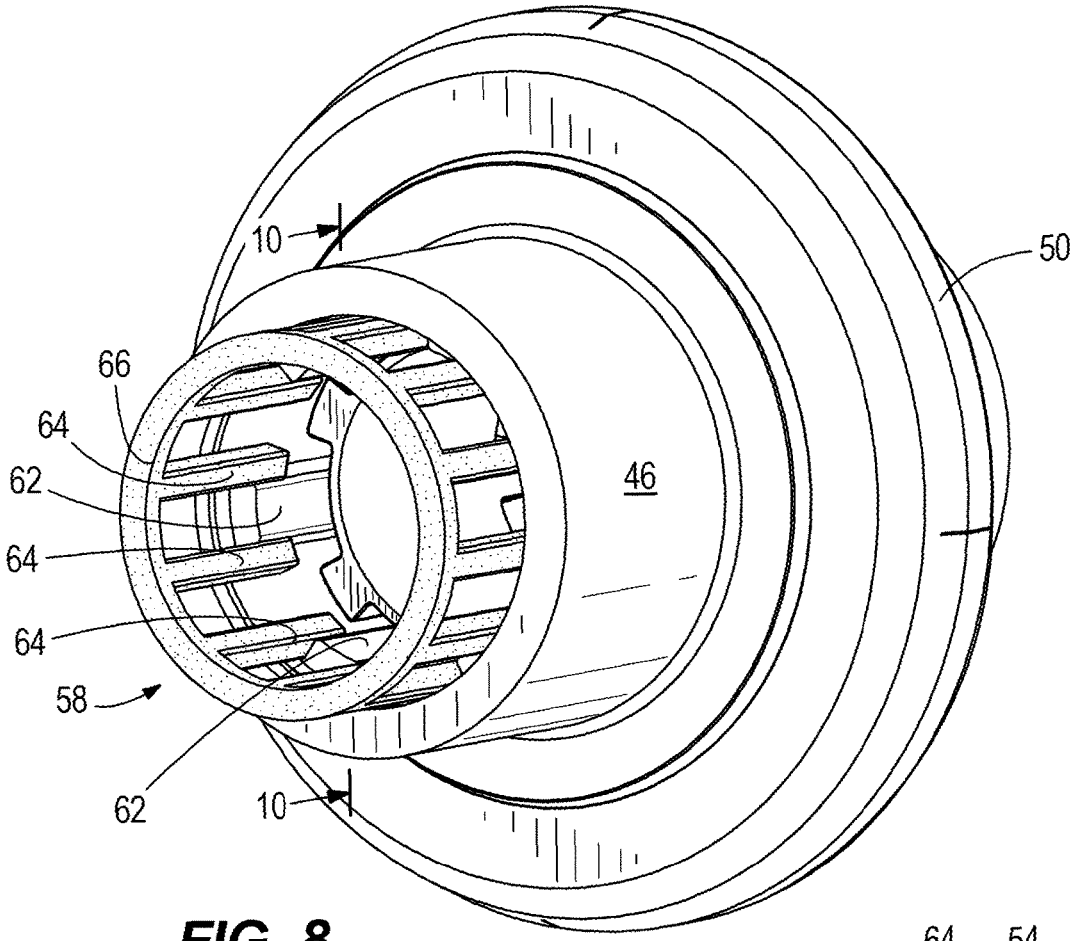
FIG. 8 is a perspective view of a gear hub and adapter according to the first example.

Now referring to FIGS. 2-7, a dog clutch 72 facilitates operable connection and disconnection of the propeller shaft 26 to the forward and reverse gear hubs 38, 40, respectively, and thus facilitates shifting of the assembly 21 into a forward gear in which forward rotation of the driveshaft 22 causes forward rotation of the propeller shaft 26 and propeller, a neutral position in which forward rotation of the driveshaft 22 does not cause rotation of the propeller shaft 26 and propeller, and a reverse gear in which forward rotation of the driveshaft 22 causes reverse rotation of the propeller shaft 26 and propeller. The type and configuration of the dog clutch 72 can vary from what is shown, and in other examples does not have to include a dog clutch but can be any other suitable clutch for enacting a gear change as summarized above. Referring to FIGS. 2 and 3, the dog clutch 72 includes a clutch body 74 which is laterally slide-able along the propeller shaft 26. Referring to FIG. 7, the clutch body 74 has opposing forward and reverse clutch dogs 76, 78 that laterally extend away from each other and are diametrically spaced apart around the clutch body 74. the clutch body 74 also has internal splines 75 that mesh with external splines 77 on the propeller shaft 26 and allow the clutch body 74 to slide. A clutch pin 80 extends through a central throughbore 81 in the clutch body 74 and through a laterally elongated slot 82 in the propeller shaft 26. The clutch pin 80 also extends through one end of a clutch actuator rod 84 which, as shown in FIG. 2, is centrally located in a laterally extending through-bore 83 in the propeller shaft 26. The opposite end of the clutch actuator rod 84 laterally extends out of the propeller shaft 26 and is operably engaged with the lower end of an elongated shift rod 86 that longitudinally extends into the gearcase 20. Referring to FIGS. 4-7, a bell crank 88 and shift spool 90 couple the shift rod 86 to the clutch actuator rod 84, as is conventional, so that rotation of the shift rod 86 about its own axis causes lateral movement of the clutch actuator rod 84 in the through-bore of the propeller shaft 26. As explained further herein below, lateral movement of the clutch actuator rod 84 causes lateral movement of the clutch pin 80 in the laterally elongated slot 82 and clutch body 74 along the propeller shaft 26, which causes the clutch body 74 to laterally slide along the propeller shaft 26, as facilitated by splines 75, 77, and moves opposite ends of the clutch body 74 into or out of engagement with the forward gear hub 38 and reverse gear hub 40 via the clutch dog 76, 78 on the clutch body 74.

Referring to FIGS. 6 and 7, the clutch dogs 76 engage with (i.e., become interdigitated with, meshed with) corresponding dogs 96 on the forward gear hub 38 when the clutch body 74 is caused to slide forwardly along the propeller shaft 26. This engages the forward gear hub 38 with the propeller shaft 26 so that forward rotation of the driveshaft 22 and forward gear hub 38 causes forward rotation of the propeller shaft 26 and associated propeller. The dogs 78 engage with (become interdigitated with, meshed with) corresponding dogs 98 on the adapter 54 when the clutch body 74 is causes to slide reversely along the propeller shaft 26. This engages the adapter 54 and reverse gear hub 40 with the propeller shaft 26 so that forward rotation of the driveshaft 22 and reverse gear hub 40 causes reverse rotation of the propeller shaft 26. The resilient element 58 advantageously facilitates relative rotation of the reverse gear hub 40 and propeller shaft 26 when the clutch body 74 is engaged with the reverse gear hub 40, as described herein above.

In use, the dog clutch 72 permits free rotation of the driveshaft 22 and bevel gear 36 when positioned in a neutral position. In neutral, the clutch body 74 is located between the opposing forward and reverse gear hubs 38, 40 and is not engaged with the respective clutch dogs 96, 98 thereof. To shift into forward gear, the shift rod 86 is rotated about its own axis by a conventional actuator, which rotates the bell crank 88, thus causing axial movement of the shift spool 90 and associated clutch actuator rod 84. Axial movement of the clutch actuator rod 84 laterally moves the clutch pin 80 within the laterally elongated slot 82 in the propeller shaft 26, while causing the clutch body 74 to slide along the propeller shaft 26 towards the forward gear hub 38 until the clutch dogs 76 on the clutch body 74 engage with (i.e. become interdigitated with) the clutch dogs 96 on the forward gear hub 38. This engages forward gear wherein forward rotation of the driveshaft 22 causes forward rotation of the forward gear hub 38, which in turn causes forward rotation of the clutch body 74 and propeller shaft 26 via the interlocking clutch dogs 76, 96 and via the splined connection between the clutch body 74 and propeller shaft 26.

To shift into reverse gear, the shift rod 86 is oppositely rotated about its own axis so as to cause opposite rotation of the bell crank 88. This causes opposite lateral movement of the shift spool 90 and associated clutch actuator rod 84. Lateral movement of the clutch actuator rod 84 causes lateral movement of the clutch pin 80 in the elongated slot 82, thus sliding the clutch body 74 laterally along the propeller shaft 26 until clutch dogs 78 on the clutch body 74 engage with clutch dogs 98 on the reverse gear hub 40. This enacts the reverse gear, wherein forward rotation of the driveshaft 22 causes reverse rotation of the reverse gear hub 40, which in turn is transmitted to the propeller shaft 26 via engagement between the reverse gear hub 40 and adapter 54, and between the adapter 54 and clutch body 74. As discussed herein above, the adapter 54 has the noted resilient element 58, which allows a certain amount of rotational movement of the reverse gear hub 40 with respect to the propeller shaft 26, thus achieving the above described objectives regarding deflection independent of the gear, thus directing certain radial and axial resultant forces through the bearings to the gearcase 20 instead of to the propeller shaft 26.

Figure 12:
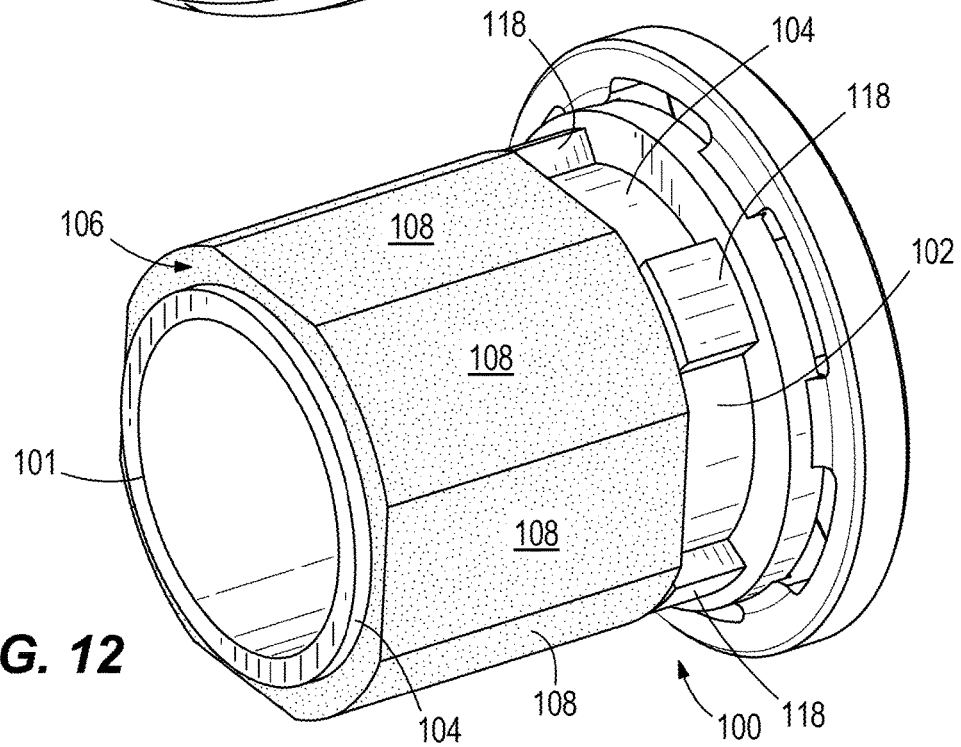
FIG. 12 is a perspective view of the adapter shown in FIG. 11.
Figure 13:
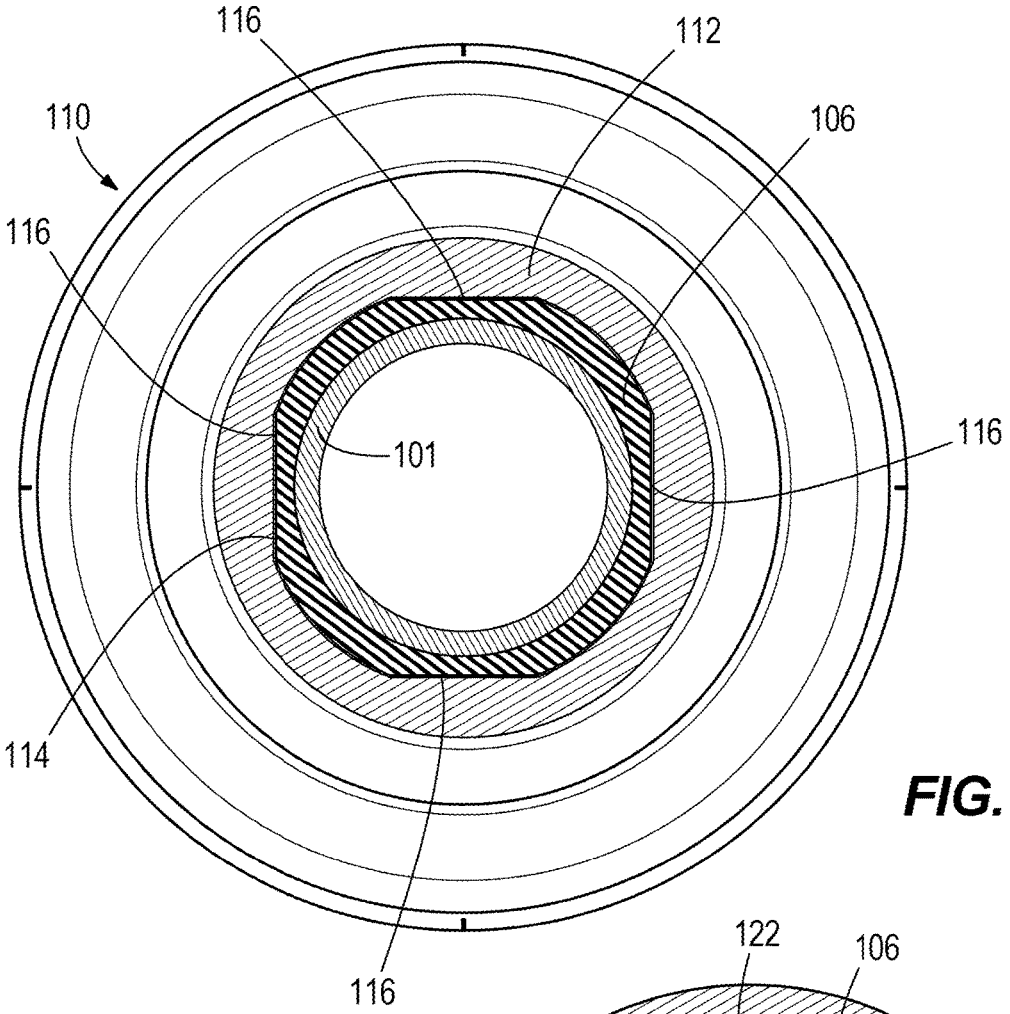
FIG. 13 is a view of section 13-13, taken in FIG. 11.
Figure 14:
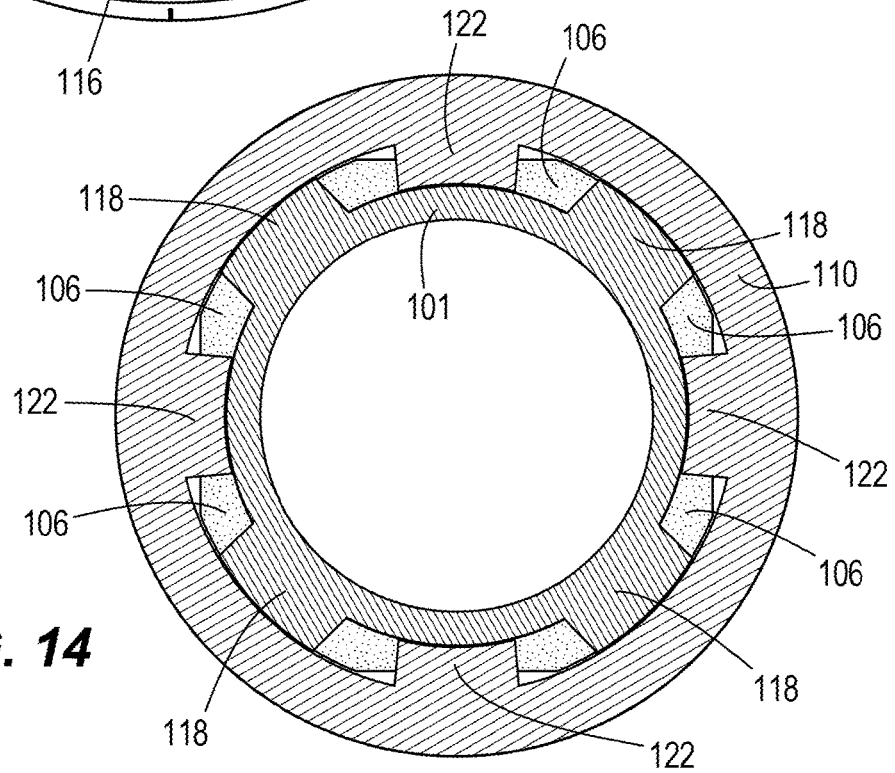
FIG. 14 is a view of section 14-14, taken in FIG. 11.

FIGS. 11-14 depict a second example of an adapter 100. In this example, the adapter 100 has an adapter body 102 with a stem 101 having a radially outer surface 104. A resilient member 106 is bonded (e.g., via adhesive) to the radially outer surface 104. The resilient member 106 does not have the fingers shown in the first example. Instead, the resilient member 106 is a monolithic sleeve having a plurality of outer flats 108 that extend around the radially outer surface 104. As shown in FIG. 13, the gear hub 110 has a hub body 112 with a radially inner surface 114. A plurality of inner flats 116 extend around the radially inner surface 114. The plurality of outer flats 108 is aligned with and engaged with the plurality of inner flats 116. Referring to FIGS. 12 and 14, plurality of outer ribs 118 are disposed around the adapter 100, laterally between the resilient member 106 and the adapter head 120. As shown in FIG. 14, the plurality of outer ribs 118 is configured to engage with corresponding inner surfaces or inner ribs 122 in the hub body 112 after said relative rotation between the propeller shaft 26 and gear hub 110 occurs. This advantageously provides a "hard stop" feature that limits the amount of relative rotation that can occur. Once engagement between the outer ribs 118 and inner ribs 122 occurs, rotation of the propeller shaft 26 is commensurate with rotation of the gear hub 110.

The concepts of the present disclosure are not limited to outboard motors and can be applied to stern drives, inboard drives, pod drives, and/or any other marine propulsion device. The concepts of the present disclosure are also not limited to single propeller arrangements and can be applied to plural propeller arrangements. The adapters of the present disclosure are also not limited for use with reverse gear hubs and can be utilized on forward gear hubs.

In the above description, certain terms have been used for brevity, clarity, and understanding. No unnecessary limitations are to be inferred therefrom beyond the requirement of the prior art because such terms are used for descriptive purposes and are intended to be broadly construed.

What is claimed is:

1. An assembly for causing rotation of a propeller on a marine drive, the assembly comprising:

a driveshaft;

a first bevel gear on the driveshaft, wherein rotation of the driveshaft causes rotation of the first bevel gear;

a propeller shaft for supporting the propeller such that rotation of the propeller shaft causes rotation of the propeller;

a gear hub on the propeller shaft;

a second bevel gear on the gear hub, wherein the second bevel gear is engaged with the first bevel gear such that rotation of the driveshaft causes rotation of the gear hub, which thereby causes rotation of the propeller shaft; and an adapter that rotationally couples the driveshaft to the propeller shaft so that rotation of the driveshaft causes rotation of the propeller shaft, wherein the adapter also facilitates relative rotation between the propeller shaft and the gear hub when the gear hub is initially caused to rotate by the driveshaft.

2. The assembly according to claim 1, wherein the driveshaft extends along and rotates about a longitudinal axis and wherein the propeller shaft extends along and rotates about a lateral axis that is perpendicular to the longitudinal axis.

3. The assembly according to claim 2, wherein the adapter is located radially between the propeller shaft and the gear hub.

4. The assembly according to claim 2, wherein the gear hub comprises a hub body that extends laterally along the propeller shaft, and wherein the adapter is located radially between the hub body and the propeller shaft.

5. An assembly for causing rotation of a propeller on a marine drive, the assembly comprising:

a driveshaft;

a first bevel gear on the driveshaft, wherein rotation of the driveshaft causes rotation of the first bevel gear;

a propeller shaft for supporting the propeller such that rotation of the propeller shaft causes rotation of the propeller;

a gear hub on the propeller shaft;

a second bevel gear on the gear hub, wherein the second bevel gear is engaged with the first bevel gear such that rotation of the driveshaft causes rotation of the gear hub, which thereby causes rotation of the propeller shaft; and an adapter facilitating relative rotation between the propeller shaft and the gear hub when the gear hub is caused to rotate by the driveshaft, wherein the adapter comprises an adapter body on the propeller shaft and a resilient element located radially between the adapter body and the gear hub, and wherein the resilient element is made of a flexible material so as to facilitate said relative rotation between the propeller shaft and the gear hub.

6. The assembly according to claim 5, wherein the adapter body comprises a stem having a plurality of laterally extending stem ribs and wherein the resilient element comprises a plurality of laterally extending fingers that are interdigitated with the plurality of laterally extending stem ribs.

7. The assembly according to claim 6, wherein the hub body has a radially inner surface and a plurality of laterally extending hub ribs that are interdigitated with the plurality of laterally extending fingers and plurality of laterally extending stem ribs.

8. The assembly according to claim 7, wherein pairs of fingers in the plurality of laterally extending fingers are located on opposite sides of each of the laterally extending stem ribs and further wherein pairs of fingers in the plurality of laterally extending fingers are located on opposite sides of each of the laterally extending hub ribs.

9. The assembly according to claim 7, wherein the plurality of laterally extending fingers are connected together at one end by a ring.

10. The assembly according to claim 7, wherein the assembly further comprises a clutch body that is slideable along the propeller shaft, and wherein the hub body further comprises a plurality of dogs that are engaged by the clutch body, which thereby engages the propeller shaft to the hub body so that rotation of the hub body causes rotation of the propeller shaft.

11. The assembly according to claim 5, wherein the adapter body has a radially outer surface and wherein the resilient member is bonded to the radially outer surface.

12. The assembly according to claim 11, wherein the resilient member comprises a plurality of outer flats extending around the radially outer surface, wherein the hub body has a radially inner surface with a plurality of inner flats extending around the radially inner surface, and wherein the plurality of outer flats is aligned with and engaged with the plurality of inner flats.

13. The assembly according to claim 12, further comprising a plurality of outer ribs on the adapter, the outer ribs configured to engage with inner surfaces of the hub body after said relative rotation between the propeller shaft and the gear hub occurs.

14. An assembly for causing rotation of a propeller on a marine drive, the assembly comprising:

a driveshaft;

a first bevel gear on the driveshaft, wherein rotation of the driveshaft causes rotation of the first bevel gear;

a propeller shaft for supporting the propeller such that rotation of the propeller shaft causes rotation of the propeller;

a gear hub on the propeller shaft;

a second bevel gear on the gear hub, wherein the second bevel gear is engaged with the first bevel gear such that rotation of the driveshaft causes rotation of the gear hub, which thereby causes rotation of the propeller shaft; and an adapter facilitating relative rotation between the propeller shaft and the gear hub when the gear hub is caused to rotate by the driveshaft, wherein the adapter comprises an adapter body on the propeller shaft and a resilient element that is located radially between the adapter body and the gear hub, and wherein the resilient element is made of a flexible material so as to facilitate said relative rotation between the propeller shaft and the gear hub.

15. The assembly according to claim 14, further comprising a plurality of outer ribs on the adapter, the outer ribs configured to engage with inner surfaces of the gear hub after said relative rotation between the propeller shaft and the gear hub occurs.

16. The assembly according to claim 1, further comprising a powerhead that causes rotation of the driveshaft.

17. The assembly according to claim 1, further comprising a dog clutch arrangement for engaging the gear hub with the propeller shaft.

18. The assembly according to claim 1, further comprising a gearcase into which the driveshaft extends, and further comprising a bearing located on the hub body, wherein the bearing supports rotation of the hub body with respect to the gearcase.

19. The assembly according to claim 18, wherein the bearing comprises a roller bearing.

20. The assembly according to claim 1, wherein the assembly consists of a single propeller arrangement.

* * * * *